US009328758B2

(12) United States Patent
Schermer et al.

(10) Patent No.: US 9,328,758 B2
(45) Date of Patent: May 3, 2016

(54) TOOTH-SET CARRIER AND OPENING CYLINDER WITH QUICK-LOCKING MECHANISM

(71) Applicant: Rieter Ingolstadt GmbH, Ingolstadt (DE)

(72) Inventors: Josef Schermer, Bergheim-Unterstall (DE); Mathias Burchert, Ostfildern (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 509 days.

(21) Appl. No.: 13/747,936

(22) Filed: Jan. 23, 2013

(65) Prior Publication Data

US 2013/0189029 A1 Jul. 25, 2013

(51) Int. Cl.

| | |
|---|---|
| ***D01H 4/32*** | (2006.01) |
| ***D01G 19/10*** | (2006.01) |
| ***F16B 17/00*** | (2006.01) |

(52) U.S. Cl.
CPC *F16B 17/00* (2013.01); *D01H 4/32* (2013.01); *Y10T 403/7007* (2015.01)

(58) Field of Classification Search
CPC ..... D01H 4/32; D01G 15/02; D01G 19/10; Y10T 403/7005; Y10T 403/7007; F16B 7/20
See application file for complete search history.

(56) References Cited

U.S. PATENT DOCUMENTS

| | | | | |
|---|---|---|---|---|
| 2,541,526 | A * | 2/1951 | Lundquist | 403/348 |
| 3,716,980 | A * | 2/1973 | Rehn et al. | 57/130 |
| 4,067,625 | A | 1/1978 | Goldammer | |
| 4,196,496 | A | 4/1980 | Stauffer et al. | |
| 4,296,527 | A | 10/1981 | Eadie | |
| 4,300,265 | A * | 11/1981 | Heinen | 19/112 |
| 4,868,952 | A | 9/1989 | Buess et al. | |
| 5,800,088 | A * | 9/1998 | Luckhof et al. | 403/349 |
| 5,899,057 | A | 5/1999 | Schuller et al. | |
| 6,843,437 | B2 | 1/2005 | Pohn et al. | |
| 2009/0038576 | A1 * | 2/2009 | Schermer et al. | 123/193.2 |
| 2012/0260464 | A1 | 10/2012 | Schermer et al. | |

FOREIGN PATENT DOCUMENTS

| | | |
|---|---|---|
| CH | 661 535 | 7/1987 |
| DE | 102 36 922 A1 | 10/2003 |

OTHER PUBLICATIONS

EPO Search Report, Jun. 5, 2013.
German Patent Office Search Report, Jun. 4, 2012.

* cited by examiner

*Primary Examiner* — Michael P Ferguson
(74) *Attorney, Agent, or Firm* — Dority & Manning, P.A.

(57) ABSTRACT

The invention refers to an opening cylinder for an open-end spinning device with a core piece and a tooth-set carrier capable of rotating around a common rotating axis and detachably connected to one another by means of a quick-locking mechanism. The quick-locking mechanism is executed as a turn-lock fastener, so that the tooth-set carrier is detachably connected to it by means of a rotational movement around the rotational axis relative to the core piece.

15 Claims, 8 Drawing Sheets

TOOTH-SET CARRIER AND OPENING CYLINDER WITH QUICK-LOCKING MECHANISM

FIELD OF THE INVENTION

This invention refers to a tooth-set carrier for an opening cylinder rotatably arranged around a rotational axis of an open-end spinning device. The tooth-set carrier can be detachably fastened to a core piece of the opening cylinder with a quick-locking mechanism. An opening cylinder for an open-end spinning device with a core piece and a tooth-set carrier that are able to rotate around a common rotating axis, detachably connected to one another by means of a quick-locking mechanism; as well as an open-end spinning device with such an opening cylinder.

BACKGROUND

DE 10 2007 037 229 A1 describes an opening cylinder for an open-end spinning device that has a core piece over which the opening cylinder is fastened to a drive shaft. Moreover, the opening cylinder has a tooth-set carrier fastened to the core piece by a clip connection in the axial direction. Furthermore, the opening cylinder has a device for the form-fitting connection of core piece and tooth-set carrier in the circumferential direction that comprises a projecting part and recess acting in conjunction with it. At the same time, the projecting part forms a snap-on shoulder of the projecting part. The disadvantage of this design is that, owing to the axial clip fastening, the connection has only a low axial retention force. Thus, during operation, the oscillations and vibrations can create a play between the tooth-set carrier and the core piece so that fibers can get stuck in the connecting area of these two components. They start accumulating and create a fiber ball that detaches after a certain amount of time, thus causing impurities and/or uneven spots in the yarn.

SUMMARY OF THE INVENTION

A task of this invention is therefore to ensure fast and easy assembly and disassembly of the tooth-set carrier while making sure it is securely fastened to the core piece. Additional objects and advantages of the invention are set forth in part in the following description, or may be obvious from the description, or may be learned through practice of the invention.

The tooth-set carrier according to the invention is intended for an opening cylinder that is part of an open-end spinning device and is rotatably arranged around a rotating axis. It has parts of a quick-locking mechanism by means of which the tooth-set carrier can be detachably fastened to a core piece of the opening cylinder. The quick-locking mechanism is shaped like a turn-lock fastener so the tooth-set carrier can be connected to (and detached from) the core piece by making a rotational movement around the turning axis that takes place relative to the core piece intended for this purpose. As a result of this, a very fast and easy assembly and disassembly of the tooth-set carrier to/from the core piece of the opening cylinder is ensured. At the same time, the turn-lock fastener ensures a secure fastening of the tooth-set carrier to the core piece because the forces acting on the connection (especially axially) cannot make the tooth-set carrier detach itself from the core piece.

A secure fastening of the tooth-set carrier to the core piece can be improved by designing the turn-lock fastener in such a way that the rotational movement for locking the tooth-set carrier to the core piece is made against the rotational direction of the opening cylinder. The main reason for this consists in the fact that the essential forces act on the connection between tooth-set carrier and core piece against the rotational direction when the opening cylinder starts moving and while the fiber ball is being disentangled. Thus, an unintended detachment of the tooth-set carrier from the core piece caused by a rotation in the rotational direction of the opening cylinder is ruled out.

It is advantageous for the tooth-set carrier to have at least one connecting element, radially spaced apart, and designed in such a way that it can complement a spring element of the core piece. In this case, it forms a form-fitting connection with the spring element in the axial direction. The connecting element is preferably built like a hook. Optionally or additionally, it can also be designed like an undercut, rib and/or groove in the tooth-set carrier. This allows the turn-lock fastener to be manufactured very easily and economically. In addition, a very strong and stable form-fitting connection between tooth-set carrier and core piece is ensured that prevents the detachment of the tooth-set carrier from the core piece caused by an axial acting force.

It is advantageous for the connecting element to have one first opening for inserting the spring element. This opening, oriented in the circumferential direction, can have a second opening that preferably points radially inward. As a result of this, the turn-lock fastener can be designed very compactly. Furthermore, this design advantageously allows the spring element to be arranged radially inward and the connecting element complementing it to be arranged radially outward on the tooth-set carrier and/or core piece, thus allowing the spring element to have a simpler design.

It is likewise advantageous when the connecting element for guiding and tensioning the spring element during the twisting process has a spring contact surface in order to ensure proper locking of the tooth-set carrier to the core piece. Regarding this, it is furthermore advantageous for the spring contact surface to point away from the core piece intended for this purpose or to point towards the tooth-set carrier because the latter will then be pressed against the core piece by means of the spring force, which is exerted from the spring element that presses against the spring contact surface.

It is also advantageous for the tooth-set carrier to have at least one first contact surface that can complement a first contact surface of the core piece in such a way that a positive locking in the circumferential direction is created between the tooth-set carrier and the core piece. The two first contact surfaces lay flat on one another when the tooth-set carrier for connecting with the core piece is twisted with regard to it, especially against rotational direction. As a result of this, a highly stable form-fitting connection capable of absorbing high forces is created between the tooth-set carrier and core piece, particularly against the rotating direction of the opening cylinder. When the opening cylinder is turned, it is therefore impossible to unintentionally loosening the connection between connecting element and spring element. In a preferred embodiment, the first contact surface has been arranged in such a way on the tooth-set carrier that it points towards the circumferential direction. As a result of this, the first contact surface can absorb very strong forces without the tooth-set carrier slipping out of the core piece.

Optionally or additionally, it is advantageous for the tooth-set carrier to have at least a second contact surface able to complement a second contact surface of the core piece in such a way that a positive locking is created between the tooth-set carrier and core piece in the axial direction. The two second contact surfaces do not lie flat on top of one another, but have a play towards each other when the tooth-set carrier is twisted for connection, especially against the rotating direction, with respect to the core piece. Thus, the second contact surfaces act as overload protection for the spring element when the tooth-set carrier could be incorrectly removed from the core piece with an axial movement. In a preferred embodiment, the first contact surface has been arranged on the tooth-set carrier in such a way that it points towards the axial direction. As a result of this, the second contact surfaces can absorb very strong forces without the tooth-set carrier slipping from the core piece.

The first contact surface can be manufactured particularly easily and economically if it is executed on the connecting element, especially as a shoulder. This design also allows an especially compact construction space design of the turning-lock fastener because an overlapping area between the two contact surfaces can be simultaneously created.

It is advantageous for the shoulder to be designed in the connecting element's first flank area and/or for this first flank to be preferably pointing against the rotational direction because it can therefore make contact with the connecting element of the core piece when the tooth-set carrier is locked in the core piece as it is turned against the rotating direction of the opening cylinder and therefore creates a form-fitting connection against the rotational direction.

For disassembling the tooth-set carrier from the core piece, it must be twisted in a rotational direction of the opening cylinder relative to the tooth-set carrier. To prevent the tooth-set carrier from accidentally detaching from the core piece and provide the user with an acoustic and/or haptic signal when he is assembling the tooth-set carrier, as soon as it has been properly fastened to the core piece, it is advantageous if the tooth-set carrier has a snap-on edge able to complement the snap-on shoulder of a spring element of the core piece.

A compact construction can be achieved if the snap-on edge is executed spacing it apart from the first flank in the circumferential direction on the connecting element, especially in the area of a second flank of the connecting element. Moreover, in this way, the two contact surfaces complementing one another come in contact only until the snap-on shoulder snaps in place in the snap-on edge when it makes contact. The shoulder and the snap-on edge are preferably located on the two opposite flanks of the connecting element.

It is advantageous for the tooth-set carrier to have a spring element able to complement the connecting element arranged on the core piece.

It is also advantageous for the tooth-set carrier to have several connecting elements spaced apart from one another in the circumferential direction. Consequently, the individual connecting elements can be made smaller, since the acting forces can then be split up among several connecting elements.

In accordance with a further development of the invention, the tooth-set carrier has at least one radial depression—particularly in its front side—that can engage in a radial elevation of the core piece, especially in its groove area, in such a way that it forms a form-fitting connection in at least one of the two circumferential directions. The depression executed in the circumferential direction in a coded angular position (and/or the form executed as depression) therefore acts as a key element to ensure that only those tooth-set carriers can be attached to a core piece—executed with the coded elevation—that have a correspondingly complementing depression. As a result of this, it can be prevented that tooth-set carrier copies—whose quality cannot be guaranteed and therefore represent a higher accident risk owing to the increased loosening danger—can be fastened to the core piece. Furthermore, in a tooth-set carrier executed as two parts with a tooth-set holder and tooth-set ring, the depression has the advantage that the ring can only be connected to the core piece if it is properly oriented with respect to it. Additionally, the form-fitting connection between the core piece and tooth-set ring executed in this way ensures the safe clinging of the tooth-set ring in the rotational direction, thus preventing a slipping of the tooth-set ring.

When the tooth-set carrier is executed as one piece or the tooth-set holder is torsion-proof connected with the tooth-set ring, it is advantageous if the depression extends in the circumferential direction over an angular area that largely corresponds to the torsion angle of the tooth-set carrier with respect to the core piece. This design thus ensures that the tooth-set carrier can be screwed into the core piece when the latter has at least one elevation. The depression and elevation complementing one another therefore create in only one of the two circumferential directions—especially against the rotational direction—a form-fitting connection of the tooth-set carrier with the core piece.

It is also advantageous for the tooth-set carrier to be made of two pieces, in which case it has one tooth-set holder and one tooth-set ring connected to it. This design allows the reduction of spare part costs, since basically only the tooth-set ring must be replaced instead of the entire tooth-set carrier.

If at least one connecting element is arranged on the tooth-set holder, the tooth-set ring can be advantageously pressed in the axial direction between the tooth-set holder and the core piece.

According to the invention, the opening cylinder has a core piece and a tooth-set carrier for an open-end spinning device. Advantageously, the opening cylinder can be torsion-proof fastened on a drive shaft of the open-end spinning device by means of the core piece. The tooth-set carrier has advantageously a tooth-set for disentangling a sliver. The core piece and the tooth-set carrier are able to rotate around a common axis and are detachably connected to one another by means of a quick-locking mechanism. The quick-locking mechanism is executed as a turn-lock fastener, so that the tooth-set carrier is detachably connected to the core piece by means of a rotational movement relative to the core piece. This ensures a very strong and secure connection between the core piece and tooth-set carrier, particularly in the axial direction, thus preventing the tooth-set carrier from detaching from the core piece. Furthermore, the turn-lock fastener allows easy and quick assembly as well as disassembly of the tooth-set carrier, thus significantly shortening the time for performing maintenance and repair work for exchanging parts subject to wear and tear, especially those of the tooth-set carrier.

In a further development of the invention, the tooth-set carrier has been executed according to the preceding description, in which case the characteristics mentioned can be present individually or in any combination.

It is advantageous for the tooth-set carrier to be form-fittingly connected in the axial direction with the core piece. This allows the connection between tooth-set carrier and core piece to absorb very strong forces in the axial direction, thus ensuring a safe anchoring of the tooth-set carrier in the core piece. Optionally or additionally, it is furthermore advantageous if the tooth-set carrier is connected to the core piece in the circumferential direction in a form- or force-fitting way. An accidental detachment of the tooth-set carrier from the core piece can be especially prevented when it is form-fittingly connected with the core piece against the rotational movement of the opening cylinder. Such a form-fitting connection is particularly suitable for absorbing strong forces acting on the tooth-set carrier and core piece connection, especially against the rotational direction, when the sliver is disentangled by the tooth-set upon rotation of the opening cylinder. Such forces acting against the rotational direction also occur when the opening cylinder starts moving. Contrary to them, only weak forces act when the opening cylinder is operated in the rotational direction. Consequently, it is advantageous when the tooth-set carrier is form-fittingly connected to the core piece (especially in the rotational direction of the opening cylinder), since an easy assembly and disassembly of the tooth-set carrier to/from the core piece is also ensured when the tooth-set carrier is sufficiently strongly connected to the core piece. Forces acting in the rotational direction occur essentially only when the speed of the opening cylinder is reduced by braking. The force- or form-fitting connection between tooth-set carrier and core piece in the opening cylinder's rotational direction has therefore been designed to withstand the braking forces and prevent detachment.

It is just as advantageous when the core piece and/or the tooth-set carrier have at least one connecting element radially spaced apart from the rotating axis. In this way, a simple rotation can mesh the connecting element with a complementing component (especially a spring element). To accomplish this, it is advantageous for the connecting element to be executed like a hook. Optionally or additionally, the connecting element can also be executed as an undercut, depression, elevation, groove and/or rib in the core piece and/or the tooth-set carrier. So this can be done, the connecting element can furthermore have a first and a second opening in which the complementing component (especially the spring element and/or a similar connecting element) engages, at least partially. In addition, a connecting element designed as a groove and/or rib can extend over the entire circumference of the core piece and/or tooth-set carrier. So the tooth-set carrier can be axially inserted into the core piece, the connecting element designed as a groove and/or rib has at least one interruption into which the complementing component (especially the spring element or another connecting element) can be inserted. Thus, the connecting elements in the core piece and/or tooth-set carrier can be advantageously manufactured very easily and economically.

In order to connect the tooth-set carrier to the core piece in the rotating direction of the opening cylinder in such a way that it can be easily assembled on the core piece and once again disassembled from it, it is advantageous if the core piece and/or tooth-set carrier have a spring element, especially a leaf spring. Needless to say, the spring element can also be executed as any other currently known spring. The spring element is arranged on the core piece and/or tooth-set carrier so it can press the core piece and the tooth-set carrier together in the axial direction, especially when it engages in the connecting element. As a result of this, a force-fitting connection is created between the core piece and the tooth-set carrier in the circumferential direction. The pressing force of the spring element is so strong that the connection does not loosen on one of the sides when the opening cylinder's speed is reduced during braking and, at the same time, it can be loosened on the other side by the muscular strength of an average person. Thus, a very quick and simple assembly and disassembly of the tooth-set carrier from the core piece while achieving a firm connection is ensured. Furthermore, the pressing together ensures a largely play-free connection between tooth-set carrier and core piece in the break-up area, particularly in the tooth-set area. Consequently, no fibers can get stuck here, thus preventing their gradual accumulation and ensuing detachment which would cause uneven spots and/or impurities in the yarn.

It is advantageous for the core piece and tooth-set carrier to have at least a first and/or second contact surface. The first contact surface is arranged on the core piece and tooth-set carrier in such a way that they fit tightly against one another when the tooth-set carrier is twisted with respect to the core piece (especially against the rotational movement) for connection with the core piece. As a result of this, a form-fitting connection of the tooth-set carrier with the core piece is advantageously created in the circumferential direction, as a result of which the turn-lock fastener is capable of absorbing strong forces, particularly against the rotational direction of the opening cylinder, that act upon the turn-lock fastener especially when the opening cylinder starts moving and the sliver is disentangled. Moreover, by means of the first contact surfaces fitting snugly against one another, a defined turning position of the tooth-set carrier with respect to the core piece—in which the connecting element and/or spring element of the tooth-set carrier are advantageously set—engages in the connecting element and/or spring element of the core piece.

The second contact surface is arranged on the core piece and tooth-set carrier so a form-fitting connection in the axial direction is created. To accomplish this, the second contact surfaces are preferably oriented in the axial direction and pointing toward each other. When the tooth-set carrier is connected to the core piece by means of the rotational movement, the second contact surfaces do not fit tightly against each another but have some play with respect to one another. Thus, the second contact surfaces act as overload protection for the spring element. Such an overload can especially occur when a user attempts to detach the tooth-set carrier from the core piece not by turning it but by making an incorrect linear axial movement. By doing this, the spring element could be deformed beyond its elastic range and the tooth-set carrier could no longer be tight-fittingly pulled towards the core piece. Before such an overload of the spring element occurs, however, the second contact surfaces bump into one another and, due to the form-fitting connection in axial direction created in this way, they can prevent a further removal of the tooth-set carrier from the core piece.

To lower manufacturing costs, it is advantageous for the first contact surface to be executed on the spring element, especially in the area of the one of its free ends, and/or the first and/or second contact surface on the connecting element, particularly in the area of a first flank. The second contact surfaces can be easily, economically, and compactly manufactured when they are executed in the connecting element like a shoulder. Furthermore, an overlapping area for the second contact surfaces can thus be simultaneously executed. The connecting element has, advantageously, a first flank and a second flank, whereby the first flank is oriented against the rotational direction of the opening cylinder and the second flank in the rotational direction of the opening cylinder. To ensure a firm form-fitting connection between both connecting elements in the circumferential direction, especially against the rotational direction, the shoulder should be executed preferably in the area of the first flank of the connecting element of the tooth-set carrier.

It is also advantageous if the spring element has at least one spring-loaded leg with a free end and a snap-on shoulder in the area of the free end, executed so it engages in a snap-on edge of the core piece and/or of the tooth-set carrier. When the snap-on shoulder engages, the assembler advantageously gets an acoustic and haptic signal, so a technician knows exactly when the tooth-set carrier is in the correct angular position with respect to the core piece. This ensures a reliable locking of the tooth-set carrier in the core piece. Furthermore, the interlocking snap-on shoulder and snap-on edge create a form- and/or force-fitting connection in the circumferential direction, thus preventing an accidental loosening of the turn-lock fastener, especially when the opening cylinder's speed is reduced by braking.

In an advantageous design, the snap-on edge on the connecting element is spaced apart from the first flank in the circumferential direction, especially in the area of a second flank of the connecting element complementing the spring element. Thus, the snap-on shoulder of the spring element engages only behind the snap-on edge when the first contact surfaces fit snugly in the circumferential direction for creating a form-fitting connection.

It is advantageous for the core piece and/or tooth-set carrier to have at least two, especially several, connecting elements spaced apart—particularly equidistantly—from one another in the circumferential direction. Each one of these connecting elements is allocated to one spring element and/or spring-loaded leg so they can complement one another. As a result of this, the connecting elements can be compactly executed because the forces acting in the circumferential and axial direction are evenly distributed on all connecting elements.

It is also advantageous if the spring element is made up of several parts, in which case especially one spring element part is allocated to one of the complementing connecting elements. As a result of this, the spring-loaded area of the leg can be advantageously executed longer and therefore softer, making it generally suitable for clip applications.

It is also advantageous if the spring element has a stop bevel with which the connecting element first makes contact when it is being assembled during the rotational movement. This favors a reliable locking of the snap-on shoulder behind the snap-on edge because the connecting element is guided through the stop bevel. Furthermore, the tensioning of the spring can take place while tightening the spring in a flat angle, as a result of which the turning strength needed for assembling the tooth-set carrier on the core piece is as low as possible.

According to the invention, the open-end spinning device has a spinning box that comprises an opening cylinder executed according to the previous description, in which case the features mentioned can be present either individually or in any combination.

BRIEF DESCRIPTION OF THE DRAWINGS

Further advantages of the invention are described in the following embodiments, which show.

DETAILED DESCRIPTION

Figure 1:
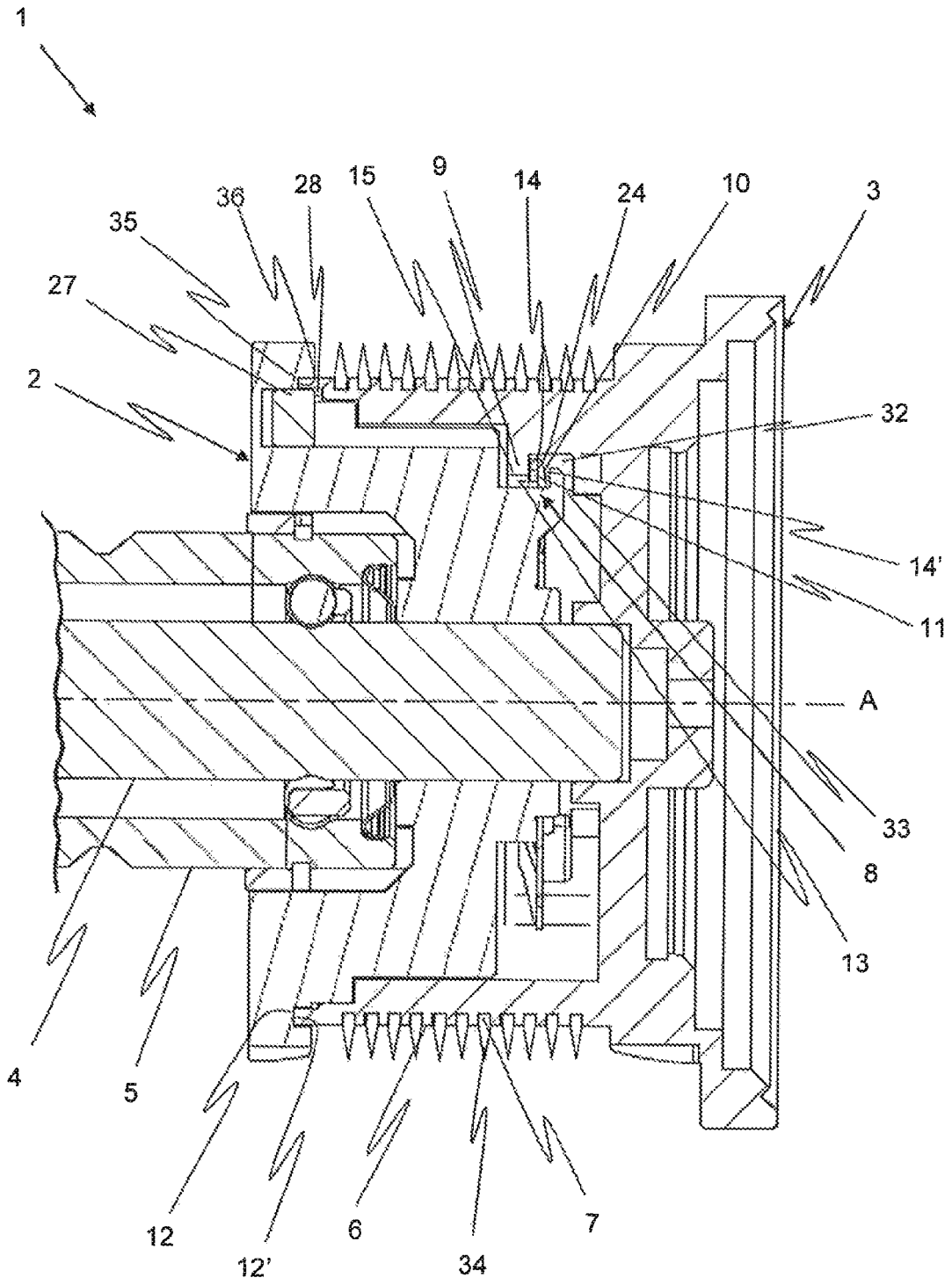
FIG. 1 a cross-section of a first embodiment of an opening cylinder with a turn-lock fastener, FIGS. 2*a* & 2*b* a core piece of the opening cylinder with a spring element executed as one single piece, FIG. 3 a tooth-set carrier with several connecting elements, FIG. 4 a second embodiment of an opening cylinder with a tooth-set carrier executed as two pieces, FIG. 5 a tooth-set carrier of the tooth-set carrier executed as two pieces, FIGS. 6*a* & 6*b* a core piece with a spring element executed as several pieces, and FIG. 7 an alternative embodiment of the spring element 11 with a first contact surface.

Reference is now made to particular embodiments of the invention, one or more examples of which are illustrated in the drawings. Each embodiment is provided by way of explanation of the invention, and not as a limitation of the invention. For example, features illustrated as described as part of one embodiment may be used with another embodiment to yield still a further embodiment. It is intended that the present invention include these and other modifications and variations.

FIG. 1 shows an opening cylinder 1 for an open-end spinning device that has a core piece 2 and a tooth-set carrier 3. The opening cylinder 1 is centered and fastened on a drive shaft 4 of the open-end spinning device (not shown in FIG. 1) by means of the core piece 2 so it cannot be twisted. The tooth-set carrier 3 is likewise centered on the drive shaft 4. The drive shaft 4 is rotatably arranged in a seat 5. The tooth-set carrier 3 has in its outer circumference 6 a spiral-shaped tooth-set depression 7, in which a tooth-set 34 has been arranged for disentangling a sliver.

The core piece 2 and the tooth-set carrier 3 are detachably connected to one another by means of a turn-lock fastener 8. The turn-lock fastener 8 is executed in a way to facilitate a very easy and fast assembly/disassembly of the tooth-set carrier 3 on/from the core piece 2 while being able to absorb a lot of force. To accomplish this, the turn-lock fastener 8 has been executed in such a way that the tooth-set carrier 3 is detachably connected to the core piece 2 by means of a rotational movement against the rotational direction R of the opening cylinder 1 (cf. FIGS. 2*a* & 3).

Figure 2A:
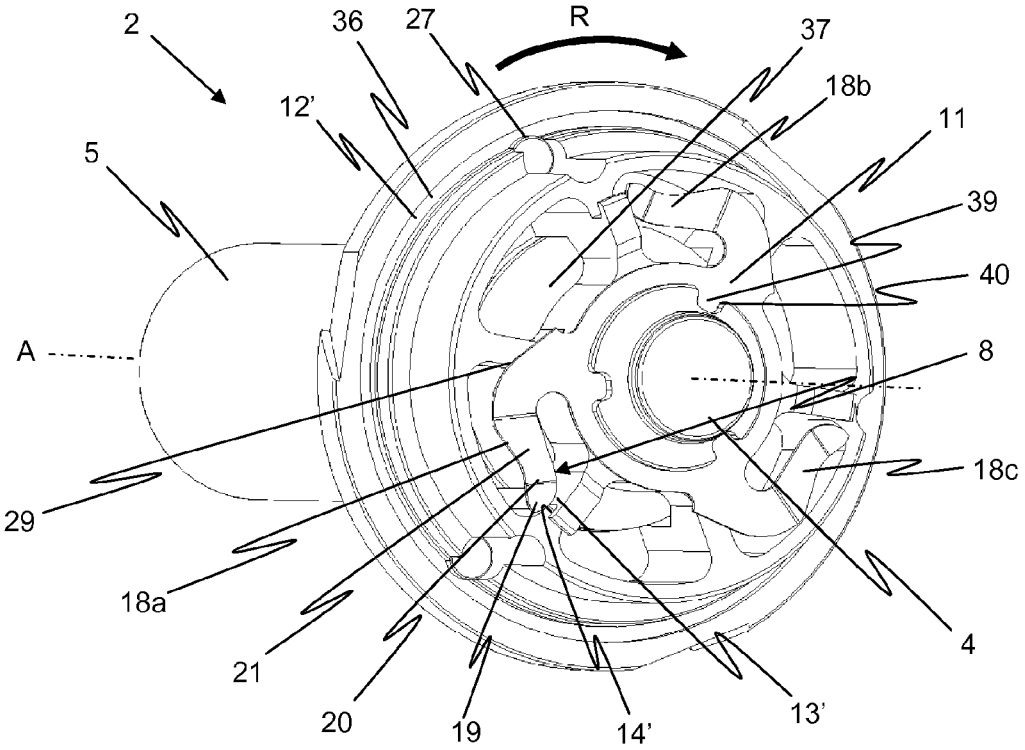
Figure 2B:
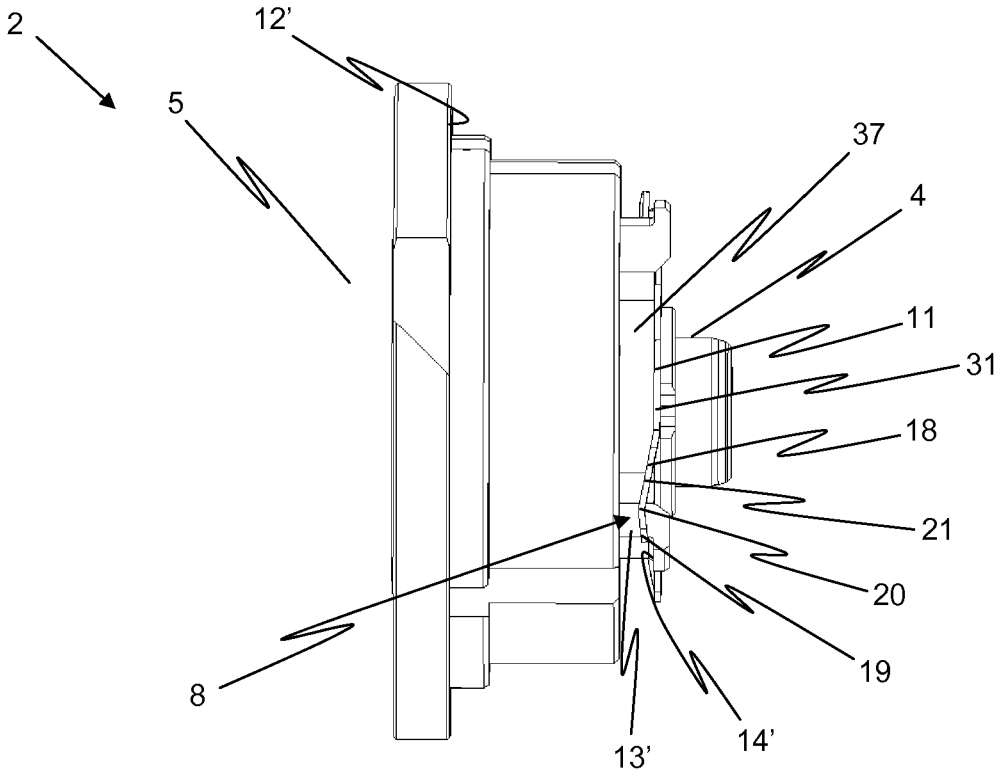
Figure 3:
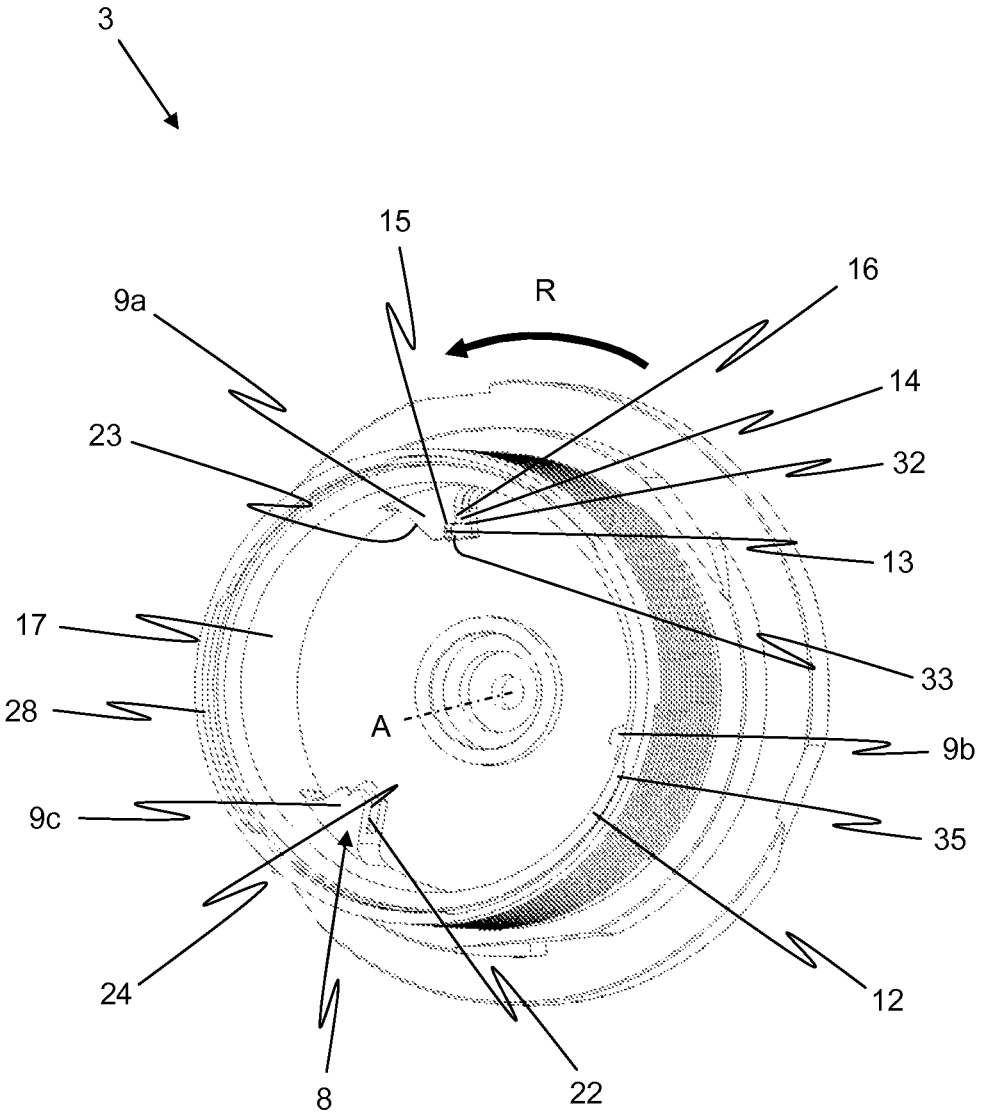

Thus, according to FIGS. 1 & 3, the tooth-set carrier 3 has connecting elements 9*a*, 9*b*, 9*c* radially spaced apart from the rotational axis A of the opening cylinder 1 and they complement a spring element 11 of the core piece 2 (shown in FIGS. 1, 2*a* & 2*b*) in such a way that a form-fitting connection between the core piece 2 and the tooth-set carrier 3 has been executed axially along the rotational axis A. The spring element 11 is tensioned in the axial direction so the tooth-set carrier 3 can be firmly pressed against the core piece 2. In this case and according to FIG. 1, the tooth-care set 3 is pressed in a circumferential groove 36 of the core piece 2 in the area of its front side 35, especially in the radially outer area—in which the tooth-set 34 has also been arranged—so that a play-free, force-fitting connection is created in the circumferential direction. Both the core piece 2 and the tooth-set carrier 3 have friction surfaces 12, 12' pressed against one another for creating the form-fitting connection. Owing to the stop defined in this way and the play-free connection of the tooth-set carrier 3 with the core piece 2, fibers are prevented from settling between the core piece 2 and the tooth-set carrier 3 that would deposit impurities on the yarn if a detachment occurs.

As can be seen in FIG. 3, the tooth-set 3 has several connecting elements 9*a*, 9*b*, 9*c* spaced apart equidistantly from one another in circumferential direction. To preserve clarity, only one of these three connecting elements 9*a*, 9*b*, 9*c* has been given reference signs. The connecting elements 9*a*, 9*b*, 9*c* are arranged on the inner circumference 17 of the tooth-set carrier 3. Every one of them has a first opening 32 and a second opening 33. The first opening 32 points towards the circumferential direction, while the second opening 33 points radially inwards. With the first and second opening 32, 33, the connecting elements 9*a*, 9*b*, 9*c* can be screwed into the spring element 11, as shown in FIG. 1.

When the tooth-set carrier 3 is connected with the core piece 2, it could be turned too much, thereby loosening the turn-lock fastener 8 again. Furthermore, when the sliver is disentangled in the circumferential direction (not shown here), particularly against the rotational direction R of the opening cylinder 1, stronger forces act on the turn-lock fastener 8 that could make the tooth-set carrier 3 detach from the core piece 2. Owing to this possibility, both the core piece 2 (according to FIGS. 2*a* & 2*b*) and the tooth-set carrier 3 (according to FIG. 3) have first contact surfaces 13, 13' that complement one another. The first contact surface 13 of the tooth-set carrier 3 is oriented toward the rotational direction R according to FIG. 3. On the other hand, the first contact surface 13' of the core piece 2 points in the rotational direction R according to FIG. 2*a*. The turn-lock fastener 8 connects form-fittingly the tooth-set carrier 3 with the core piece 2 in the circumferential direction by means of the first two contact surfaces 13, 13'. To do this, the two first contact surfaces 13, 13' that complement one another fit tightly against each other in the circumferential direction when the tooth-set carrier 3 according to FIG. 1 has been twisted with respect to the core piece 2 for completing the locking process.

According to FIG. 3, the first contact surface 13 of the tooth-set carrier 3 has been executed like a shoulder 15 in the area of a first flank 16 of the connecting element 9*a*, 9*b*, 9*c*. The first flank 16 of the connecting element 9*a*, 9*b*, 9*c* points towards the rotational direction R, so that when the tooth-set carrier 3 is twisted against the rotational direction R, it strikes the first contact surface 13 of the tooth-set carrier 3 (created with the shoulder 15) against the first contact surface 13' of the core piece 2. As a result of this, a form-fitting connection is created between the core piece 2 and the tooth-set carrier 3 in the circumferential direction.

Furthermore, both the core piece 2 and the tooth-set carrier 3 have a second contact surface 14, 14'. Owing to the shoulder 15, the tooth-set carrier 3 can be twisted even further (with respect to the core piece 2) around the length of the shoulder 15 extending in the circumferential direction, so that the two complementing contact surfaces 14, 14' overlap at least partially and create a form-fitting connection with one another in the axial direction. The second contact surfaces 14, 14' are oriented in the axial direction and facing each other. When the tooth-set carrier 3 is connected to the core piece 2 by means of the rotational movement, the two second contact surfaces 14, 14' do not fit tightly against one another but have a play 10 with respect to each other. The second contact surfaces 14, 14' act as overload protection for the spring element 11 in the axial direction. An excessive load can occur especially when a user does not try to detach the tooth-set carrier 3 by twisting it from the core piece 2 but instead does it incorrectly by making a linear movement along the rotational axis A. If this occurs, the spring element 11 can be deformed beyond its elastic range and the tooth-set carrier 3 can no longer be pulled tight fittingly along the core piece 2. Before such an overload of the spring element 11 takes place, however, the two contact surfaces 14, 14' bump into one another and the form-fitting connection thus created in the axial direction prevents a further axial detachment of the tooth-set carrier 3 from the core piece 2. The play 10 has been executed smaller than the maximum spring deflection of the spring element 11 in the axial direction within the elastic range.

FIGS. 2*a* & 2*b* show the core piece 2 of the opening cylinder 1 shown in FIG. 1. The turn-lock fastener 8 comprises—apart from the first 13' and second 14' contact surface—the spring element 11 too. In this embodiment, the spring element 11 has been executed as a one-piece leaf spring and is tensed so it can engage in the connecting element 9*a*, 9*b*, 9*c* (in each case by means of a spring contact surface 24 in accordance with FIG. 3) and pull the tooth-set carrier 3 in the axial direction towards the core piece 2. As a result of that and according to FIG. 1, the friction surface 12 of the tooth-set carrier 3 (arranged in the front-side area) is pressed in such a way against the friction surfaces 12' of the core piece 2 that have been executed in the groove 36 that a force-fitting connection is created between the core piece 2 and the tooth-set carrier 3 in the circumferential direction, especially in the rotational direction R of the opening cylinder 1.

According to FIGS. 2*a* & 2*b*, the spring element 11 has been executed as one single piece and connected to the core piece 2 in a way to prevent twisting. To achieve this, the spring element 11 has teeth 39 that engage in recesses 40 of the core piece 2 in such a way that a form-fitting connection is created in the circumferential direction. The teeth 39 and recesses 40 are executed along defined angular intervals so that the spring element 11 is always positioned in the correct angular position pointing to the first contact surfaces 13'. The spring element 11 is fixed to the core piece 2, especially through caulking.

The spring element 11 has several legs 18*a*, 18*b*, 18*c*, each one allocated to one of the connecting elements 9*a*, 9*b*, 9*c* of the tooth-set carrier 3. For clarity reasons, only one of the legs 18*a*, 18*b*, 18*c* has been given reference characters. Each one of the legs 18*a*, 18*b*, 18*c* has a snap-on shoulder 20 in the area of its free end 19. The first contact surfaces 13' are arranged on the core piece 2, in each case in the area of the free ends 19 of the spring-loaded legs 18*a*, 18*b*, 18*c*. The legs 18*a*, 18*b*, 18*c* encompass a bending area 21, so that the free end 19 and snap-on shoulder 20 are executed by and large flexibly in the axial direction. The bending area 21 has been executed adjacently to the snap-on shoulder 20. The legs 18*a*, 18*b*, 18*c* of the spring element 11 fastened to the core piece 2 are arranged along the same angular intervals as the connecting elements 9*a*, 9*b*, 9*c* of the tooth-set carrier 3, so that they can complement the connecting elements 9*a*, 9*b*, 9*c* of the tooth-set carrier 3. To make this possible, each one of the connecting elements 9*a*, 9*b*, 9*c* of the tooth-set carrier 3 has a snap-on edge 22 in accordance with FIG. 3. This edge has been executed in the area of a second flank 23 of the connecting element 9*a*, 9*b*, 9*c* complementing the spring element 11. The snap-on edge 22 is executed at an inclined angle to the first contact surface 13.

To connect the tooth-set carrier 3 with the core piece 2 to an opening cylinder 1, the tooth-set carrier 3 is first placed on the core piece 2 in the axial direction (cf. FIGS. 1-3). According to FIG. 2*a*, in its external circumferential area—and especially in the groove 36—the core piece 2 has elevations 27 that prevent a tooth-set carrier 3 positioned at the incorrect angle to the core piece 2 to further approach in the axial direction. According to FIG. 3, the tooth-set carrier 3 has depressions 28 executed in the area of the front side 35 of the tooth-set carrier 3, especially in its inner circumference 17 area. As soon as the tooth-set carrier 3 is in the appropriate angular position with respect to the core piece 2, the elevations 27 engage in the corresponding depression 28 of the tooth-set carrier 3. In this case, the tooth-set carrier 3 penetrates the circumferential groove 36 of the core piece 2 in the area of its front side 35, so that the tooth-set carrier 3 is form-fittingly connected to the core piece 2 in the radial direction and held in the circumferential direction. The tooth-set carrier 3 is now furthermore centered on the drive shaft 4.

The connecting elements 9*a*, 9*b*, 9*c* of the tooth-set carrier 3 are located in circumferential direction, in each case in an insertion area 37 of the spring element 11, executed in each case between two adjacent legs 18*a*, 18*b*, 18*c* of the spring element 11. According to FIG. 3, the depressions 28 extend in the circumferential direction over an angular area, which essentially corresponds to the twisting angle of the tooth-set carrier 3 with respect to the core piece 2. This allows the tooth-set carrier 3 to be screwed into the core piece 2.

If the tooth-set carrier 3 is turned relative to the core piece 2 against the rotational direction R, the connecting elements 9*a*, 9*b*, 9*c* envelop the correspondingly allocated legs 18*a*, 18*b*, 18*c* of the spring element 11. Here, the area of the legs 18*a*, 18*b*, 18*c* looking away from the free end 19 penetrate the first and second opening 32, 33 of the corresponding connecting element 9*a*, 9*b*, 9*c*. Now the tooth-set carrier 3 is form-fittingly connected—with play—to the core piece 2 in the axial direction.

A further twisting causes the spring contact surfaces 24 of the connecting elements 9*a*, 9*b*, 9*c* to make contact with the respective legs 18*a*, 18*b*, 18*c* in the bending area 21 because the legs 18*a*, 18*b*, 18*c* are curved in axial direction towards the core piece 2 in the bending area 21. The spring contact surfaces 24 point away from the core piece 2. If twisted further, the connecting elements 9*a*, 9*b*, 9*c* move in the circumferential direction towards the free ends 19. In this case, the legs 18*a*, 18*b*, 18*c* are elastically deformed in their bending areas 21, whereby the free ends 19 of the legs 18*a*, 18*b*, 18*c* are pushed away from the core piece 2 in the axial direction by means of the spring contact surfaces 24. The tooth-set carrier 3 is thus pressed in the axial direction with its front side 35 into the groove 36 of the core piece 2, so that a force-fitting connection is created in the circumferential direction.

If the tooth-set carrier 3 is continuously twisted further against the rotational direction R of the opening cylinder 1, the legs 18*a*, 18*b*, 18*c* are tensed increasingly more by the spring contact surfaces 24 of the connecting elements 9*a*, 9*b*, 9*c* until the first contact surfaces 13 of the connecting elements 9*a*, 9*b*, 9*c* of the tooth-set carrier 3 touch the first contact surfaces 13' of the core piece 2. Essentially simultaneously, the snap-on shoulders 20 of the spring element 11 lock in position and create a form-fitting connection in the snap-on edges 22 of the connecting elements 9*a*, 9*b*, 9*c* of the tooth-set carrier 3. The second contact surfaces 14 now overlap in the axial direction and have a play 10 together.

The tooth-set carrier 3 is now form-fittingly connected with the core piece 2 in the axial direction by means of the legs 18*a*, 18*b*, 18*c* of the spring element 11 that engage in the connecting elements 9*a*, 9*b*, 9*c*. There is also a form-fitting connection against the rotational direction R of the opening cylinder 1 owing to the first contact surfaces 13, 13' complementing each other. In the rotational direction R, the tooth-set carrier 3 is force-fittingly connected to the core piece 2 through the friction surfaces 12, 12' complementing one another, which are pressed against each other in the axial direction with the spring element 11. Furthermore, there is a form- and/or force-fitting connection in the rotational direction R owing to the snap-on shoulder 20 that has engaged in the snap-on edge 22.

To detach the tooth-set carrier 3 from the core piece 2, it must be twisted in the rotational direction R with respect to the core piece 2. When doing this, the spring force of the spring element 11 acting in axial direction must be overcome so the snap-on shoulder 20 snaps off the snap-on edge 22.

Figure 4:
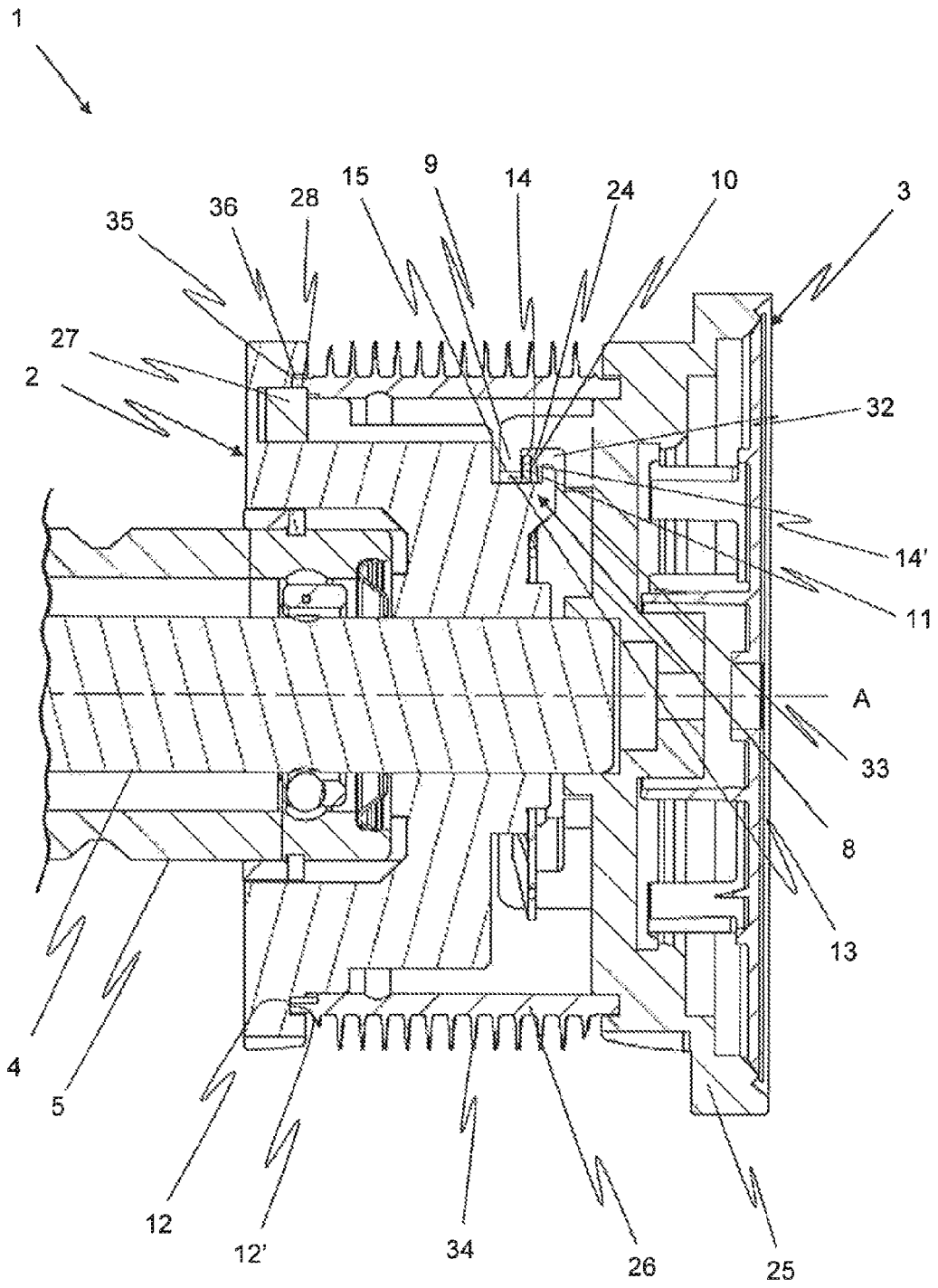

FIG. 4 shows an alternative embodiment of the opening cylinder 1 with a tooth-set carrier 3 executed as two pieces. Thus, the tooth-set carrier 3 has a tooth-set holder 25 and a tooth-set ring 26 connected to it. The tooth-set ring 26 is form-fittingly connected with the core piece 2 and the tooth-set holder 25 in the axial and radial direction. Furthermore, the core piece 2 has elevations 27 in its outer circumferential area that engage form-fittingly in depressions 28 of the tooth-set ring 26. Contrary to the first embodiment shown in FIGS. 1-3, the depressions 28 do not extend over such an angular area, so that there is a twist-proof connection between tooth-set ring 26 and core piece 2. Consequently, for closing the turn-lock fastener 8, the tooth-set holder 25 is twisted with respect to the core piece 2 and the tooth-set ring 26 is form-fittingly connected in circumferential direction to it.

In the axial direction, the depressions 28 are executed only in the area of the front side 35 of the tooth-set carrier 3 or in the area of the tooth-set ring 26 facing the core piece 2. As a result of this, it can be advantageously ensured that the tooth-set ring 26 can be connected to the core piece 2 only if correctly oriented, thus preventing the mounting of the tooth-set ring 26 with an incorrectly oriented tooth-set. Due to the fact that the tooth-set carrier 3 is executed in several pieces, the entire tooth-set carrier 3 needs no replacement if the tooth-set is closed, which is a big advantage, but merely the tooth-set ring 26.

In the two-piece embodiment of the tooth-set carrier 3 shown in FIG. 4, the tooth-set holder 25 is centered on the drive shaft 4. On the other hand, the tooth-set ring 26 sits in the tooth-set holder 25 with little play and is centered on the core piece 2.

Figure 5:
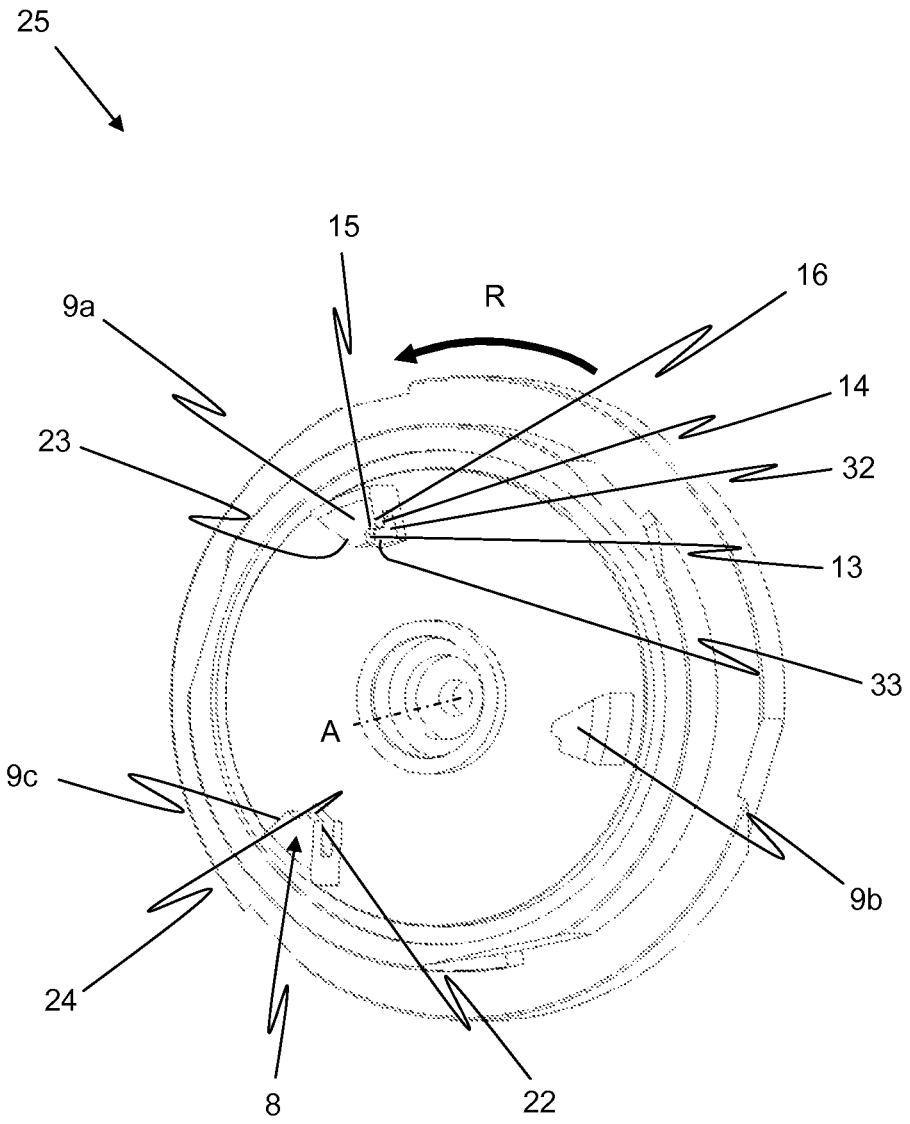

FIG. 5 shows a perspective view of the tooth-set holder 25. Here, too, the connecting elements 9*a*, 9*b*, 9*c* are spaced apart from one another on the tooth-set holder 25 in the circumferential direction. The connecting elements 9*a*, 9*b*, 9*c* have been executed so they are equidistantly separated from each other.

When according to FIG. 3 the depression 28 of the tooth-set carrier 3 extends over an angular interval in the circumferential direction (as described above), the core piece 2 does not have to be modified (an advantage) so it can accept both the one-piece tooth-set carrier 3 according to FIG. 3 and the two-piece tooth-set carrier 3, especially the tooth-set ring 26.

Figure 6A:
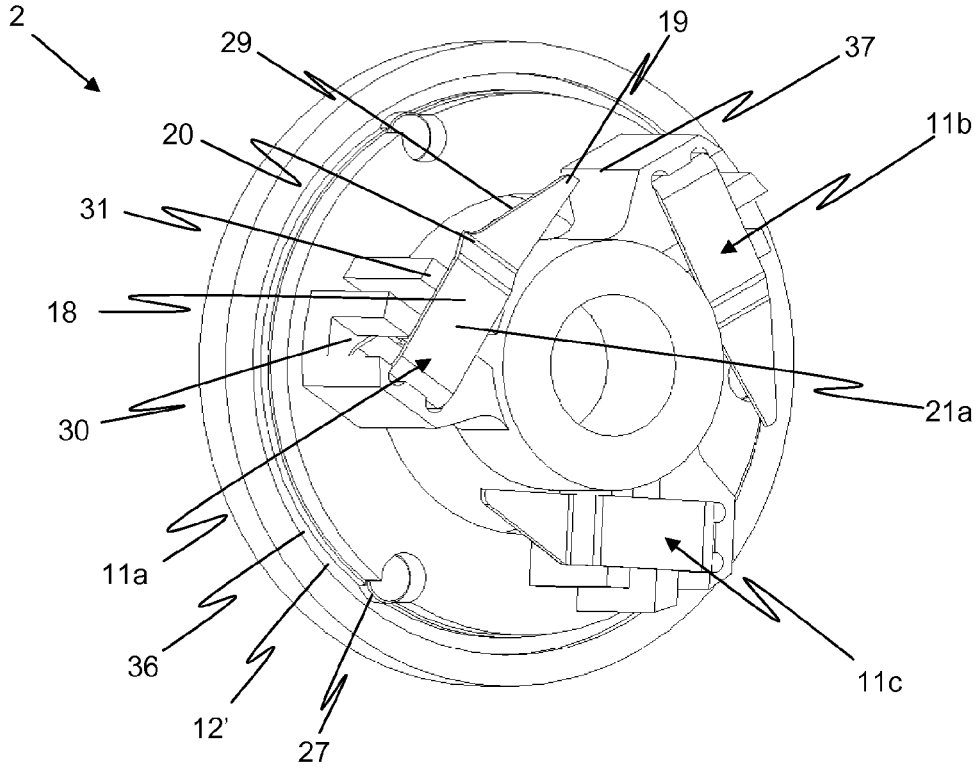
Figure 6B:
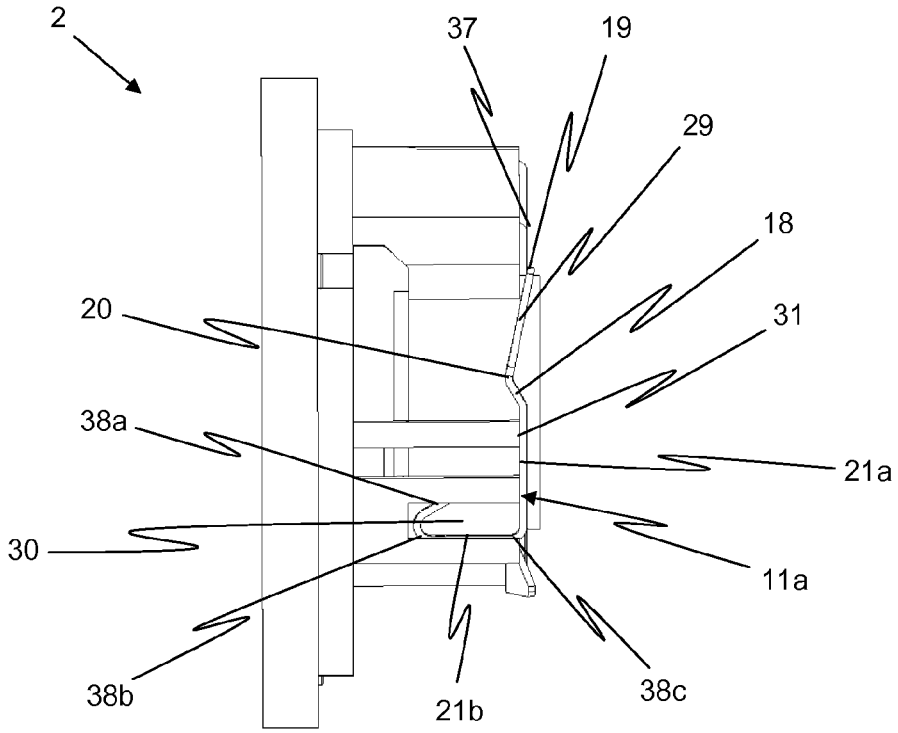

FIGS. 6*a* & 6*b* show an alternative embodiment of the spring element 11, which has been executed in several pieces here. Thus, the core piece 2 has a separate spring element 11*a*, 11*b*, 11*c* for every one of the connecting elements 9*a*, 9*b*, 9*c* of the tooth-set carrier 3 shown in FIG. 5. Every one of these spring elements 11*a*, 11*b*, 11*c* has been executed with one leg 18. In contrast to the spring element 11 executed as one single piece according to FIGS. 2*a* & 2*b*, the spring elements 11*a*, 11*b*, 11*c* are oriented in circumferential direction in such a way that the free ends 19 point towards the rotational direction and thus come in contact at first with the connecting elements 9*a*, 9*b*, 9*c*. Owing to this reason, each one of the spring elements 11*a*, 11*b*, 11*c* additionally includes a stop bevel 29. The stop bevel 29 is executed in the area of the free end 19 and ends at the snap-on shoulder 20 starting from the free end.

As can be seen in FIG. 6*b*, every one of the spring elements 11*a*, 11*b*, 11*c* is hooked in a holding opening 30 of the core piece 2. Here, the holding opening 30 of each one of the spring elements 11 has a first, second and third supporting point 38*a*, 38*b*, 38*c*. The spring element 11 has a first bending area 21*a* executed in the area of the leg 18. Moreover, the spring element 11 also has a second bending area 21*b* executed between the second and third supporting point 38*b*, 38*c* in the holding opening 30. When the tooth-set carrier 3 is screwed into the core piece 2, the free ends 19 of the spring elements 11*a*, 11*b*, 11*c* are pushed away from the core piece 2 in the axial direction. In this case, the spring elements 11*a*, 11 *b*, 11*c* are bent in their first and second bending area 21*a*, 21 *b*, in which case the second bending area 21*b* is bulbously bent into the holding opening 30. Furthermore, the core piece 2 has a bearing surface 31 on which the spring element 11 lies on top in a pre-stressed state. As a result of this, the stop bevel 29 can be advantageously made shorter.

Figure 7:
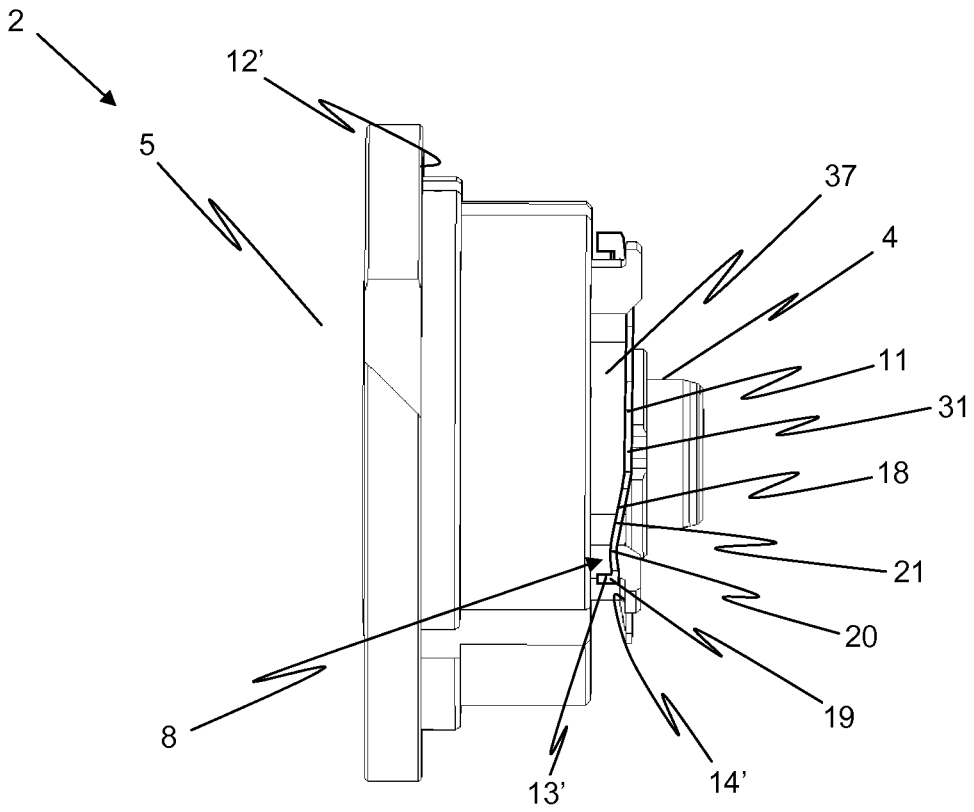

FIG. 7 shows an alternative embodiment of the core piece 2, in which the spring element 11 has the first contact surface 13'. Here, the first contact surface 13' is executed in the area of the free ends 19 of the legs 18. Starting from the free end 19, the contact surface 13' extends parallel to the rotational axis R towards the core piece 2.

This invention is not limited to the embodiments shown and described, as the patent claims allow modifications such as a combination of the characteristics even if they show and describe different embodiments. Consequently, the tooth-set carrier can have—additionally or alternatively—all characteristics of the core piece described above. The same applies in reverse to the core piece.

The invention claimed is:

1. An opening cylinder for an open-end spinning machine, comprising:

a cylindrical core piece fixable to a distal end of a drive shaft, the core piece comprising a circumferential wall having an outer surface having a front end and a rear end, a frontward facing annular face disposed adjacent to and radially projecting from the rear end of the outer surface defining a friction surface, a radially-extending projection disposed adjacent to the front end of the outer surface having a circumferentially-facing surface defining a first contact surface;

a cylindrical tooth-set carrier detachably connected to the core piece such that the tooth-set carrier and the core piece rotate relative to a common rotational axis, the tooth-set carrier comprising a circumferential wall concentrically received on the circumferential wall of the core piece and having an inner surface having a front end and a rear end, at least one connecting element radially-inwardly extending from the inner surface adjacent to the front end, the rear end having an annular face defining a friction surface complementary to the friction surface of the core piece, the connecting element comprising a shoulder formed in a first flank of the connecting element having a circumferentially-facing surface defining a first contact surface complementary to the contact surface of the core piece; and an annular spring element concentrically disposed on the front end of the outer surface of the core piece, the spring element comprising at least one radially-outwardly extending spring-loaded leg having a free end configured to engage a respective connecting element on the tooth-set carrier, when the core piece is concentrically received within the tooth-set carrier, upon relative rotation between the tooth-set carrier and the core piece, wherein rotational engagement of the spring element and the connecting element draws the core piece and the tooth-set carrier axially towards each other to axially and circumferentially lock the tooth-set carrier to the core piece;

the friction surfaces of the core piece and the tooth-set carrier being drawn against one another in an axial direction by engagement of the spring-loaded leg and the connecting element to form a force-fitting connection in an operational rotational direction of the opening cylinder that transmits torque to the tooth set carrier; and the first contact surfaces of tooth-set carrier and the core piece being drawn against one another in the operational rotational direction by the rotational engagement of spring element and the connecting element to form a positive locking connection in the circumferential direction between the tooth-set carrier and the core piece against relative rotation in a direction opposite to the operational rotational direction.

2. The opening cylinder as in claim 1, wherein in a connected state of the tooth-set carrier on the core piece, a form-fitting frictional connection is defined in the axial and circumferential directions between the tooth-set carrier and the core piece by an annular groove.

3. The opening cylinder as in claim 1, further comprising second opposing contact surfaces defined on the connecting element and the spring element respectively in an axial direction.

4. The opening cylinder as in claim 1, further comprising a snap-on shoulder defined at the free end of the spring-loaded leg that engages with a snap-on edge defined on the connecting element by a second flank of the connecting element.

5. The opening cylinder as in claim 4, further comprising a plurality of the connecting elements circumferentially spaced around the tooth-set carrier, and a plurality of the spring-loaded legs circumferentially spaced around the core piece.

6. The opening cylinder as in claim 5, wherein the spring-loaded legs are individual components disconnected from each other and individually retained on the core piece.

7. The opening cylinder as in claim 1, wherein the at least one connecting elements are hook-shaped.

8. The opening cylinder as in claim 7, wherein the connecting element comprises a first opening oriented in the circumferential direction and a second opening oriented in the radial direction for engagement with the spring-loaded leg.

9. The opening cylinder as in claim 8, wherein the connecting element further comprises a spring contact surface configured to press against the spring-loaded leg.

10. The opening cylinder as in claim 7, wherein the connecting element comprises a snap-on edge defined by the first flank that is configured to engage with a snap-on shoulder defined at the free end of the spring-loaded leg of a spring element on the core piece.

11. The opening cylinder as in claim 7, comprising a plurality of the connecting elements circumferentially spaced around the tooth-set carrier for engagement with a plurality of the spring-loaded legs circumferentially spaced around the core piece.

12. The opening cylinder as in claim 1, comprising a radial depression defined in the rear end of the tooth-set carrier, the radial depression configured for engagement with a radial elevation disposed on the flange of the core piece to define a form-fitting circumferentially extending connection between the tooth-set carrier and the core piece.

13. The opening cylinder as in claim 12, wherein the radial depression extends in the circumferential direction over an angular range that corresponds to a twisting angle of the tooth set carrier relative to the core piece when connecting the tooth set carrier to the core piece.

14. The opening cylinder as in claim 1, wherein the tooth set carrier comprises a tooth set holder.

15. The opening cylinder as in claim 14, wherein the at least one connecting elements are hook-shaped.

* * * * *